US012258693B2

(12) United States Patent
Hamajima et al.

(10) Patent No.: US 12,258,693 B2
(45) Date of Patent: Mar. 25, 2025

(54) SEWING MACHINE AND EMBROIDERY DEVICE

(71) Applicant: BROTHER KOGYO KABUSHIKI KAISHA, Nagoya (JP)

(72) Inventors: Eiichi Hamajima, Kasugai (JP); Masakazu Nakano, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 43 days.

(21) Appl. No.: 18/188,680

(22) Filed: Mar. 23, 2023

(65) Prior Publication Data

US 2023/0304203 A1 Sep. 28, 2023

(30) Foreign Application Priority Data

Mar. 25, 2022 (JP) ..... 2022-050131

(51) Int. Cl.
*D05B 19/14* (2006.01)

(52) U.S. Cl.
CPC ..... *D05B 19/14* (2013.01)

(58) Field of Classification Search
None
See application file for complete search history.

(56) References Cited

U.S. PATENT DOCUMENTS 3,957,003 A * 5/1976 Drevet ..... D05B 57/00 112/467
4,092,937 A * 6/1978 Landau, Jr. ..... G05B 19/425 112/470.04
4,262,614 A * 4/1981 Sugaya ..... D05B 19/105 112/275
4,459,926 A * 7/1984 Ohniwa ..... G05B 19/40 112/102.5
4,577,576 A * 3/1986 Hanyu ..... D05B 19/00 112/456
4,791,344 A * 12/1988 Yoshida ..... D05B 69/22 318/369
4,936,232 A * 6/1990 Monma ..... D05B 19/02 112/155
4,986,201 A * 1/1991 Hyodo ..... D05B 27/22 112/456

(Continued)

FOREIGN PATENT DOCUMENTS

JP H11-262594 A 9/1999

*Primary Examiner* — Grace Huang
(74) *Attorney, Agent, or Firm* — Oliff PLC

(57) ABSTRACT

A sewing machine includes a sewing unit including a sewing machine motor, a single terminal for connecting a foot controller to the sewing machine, and a controller that controls the sewing unit. When the foot controller is not connected to the sewing machine, the single terminal allows connection of an external device to the sewing machine. The controller performs: a speed-data receiving operation to receive speed data from the foot controller connected to the sewing machine via the single terminal for controlling a sewing speed; a speed-control operation to control the sewing machine motor in accordance with the speed data received in the speed-data receiving operation; an input-data receiving operation to receive input data from the external device connected to the sewing machine via the single terminal; and a data-outputting operation to output output data to the external device via the single terminal.

12 Claims, 9 Drawing Sheets

(56) References Cited

U.S. PATENT DOCUMENTS

| | | | | |
|---|---|---|---|---|
| 5,284,104 | A | 2/1994 | Hori et al. | |
| 5,537,945 | A * | 7/1996 | Sugihara | D05B 19/02 112/155 |
| 5,778,808 | A * | 7/1998 | Hirata | D05B 19/04 112/102.5 |
| 5,862,768 | A * | 1/1999 | Tsukahara | D05B 69/20 112/277 |
| 6,161,491 | A * | 12/2000 | Takenoya | D05B 79/00 112/456 |
| 7,007,619 | B2 * | 3/2006 | Hamajima | D05B 69/18 318/551 |
| 7,313,457 | B2 * | 12/2007 | Yoshimura | D05B 19/10 700/138 |
| 7,962,239 | B2 * | 6/2011 | Hirata | G05B 19/40932 112/470.01 |
| 8,108,062 | B2 * | 1/2012 | Kaymer | G05B 19/408 700/138 |
| 8,146,521 | B2 * | 4/2012 | Nakamura | D05B 19/12 112/102.5 |
| 8,286,569 | B2 * | 10/2012 | Nishiyama | D05B 55/14 112/273 |
| 8,307,772 | B2 * | 11/2012 | Nakashima | D05C 7/00 112/2 |
| 8,671,859 | B2 * | 3/2014 | Kawaguchi | D05C 9/04 112/103 |
| 9,347,160 | B2 * | 5/2016 | Maki | D05C 7/04 |
| 9,951,449 | B2 * | 4/2018 | Gieskes | D05B 19/12 |
| 10,662,564 | B2 * | 5/2020 | Yokoyama | G05B 19/40935 |
| 2007/0256618 | A1 * | 11/2007 | Hamajima | H02P 27/024 112/277 |

* cited by examiner

SEWING MACHINE AND EMBROIDERY DEVICE

REFERENCE TO RELATED APPLICATIONS

This application claims priority from Japanese Patent Application No. 2022-050131 filed on Mar. 25, 2022. The entire content of the priority application is incorporated herein by reference.

BACKGROUND ART

A known sewing machine includes a foot controller jack to which a cable of a foot controller is detachably connected. The known sewing machine receives data from an embroidery device when the embroidery device is connected to the sewing machine via the foot controller jack instead of the foot controller.

DESCRIPTION

The foot controller jack of the known sewing machine is not designed to be used to output data from the sewing machine to an external device. To connect the known sewing machine to an external device such as an embroidery device that is operational in synchronization with the sewing machine, the known sewing machine is to have a connection terminal in addition to the foot controller jack.

An object of the disclosure is to provide a sewing machine that can transmit and receive data to and from an external device with a simpler configuration than before, an embroidery device, and a non-transitory computer-readable storage medium storing a sewing machine program.

A first aspect of the disclosure provides a sewing machine that includes a sewing unit, a single terminal for connecting a foot controller to the sewing machine, and a controller configured to control the sewing unit. The sewing unit includes a sewing machine motor and a needle bar having a lower end to which a needle is attachable. The sewing unit drives the needle bar with power of the sewing machine motor for forming stitches. When the foot controller is not connected to the sewing machine, the single terminal allows connection of an external device to the sewing machine. The controller performs: a speed-data receiving operation to receive speed data from the foot controller connected to the sewing machine via the single terminal for controlling a sewing speed; a speed-control operation to control the sewing machine motor in accordance with the speed data received in the speed-data receiving operation; an input-data receiving operation to receive input data from the external device connected to the sewing machine via the single terminal; and a data-outputting operation to output output data to the external device via the single terminal. The sewing machine can output data to an external device and obtain data from the external device via the single terminal.

A second aspect of the disclosure provides an embroidery device that includes a connector connectable to the single terminal of the sewing machine according to the first aspect of the disclosure, the embroidery hoop for holding the workpiece, the moving unit configured to move the embroidery hoop relative to the needle bar of the sewing machine, and the embroidery-device controller configured to control the moving unit to move the embroidery hoop relative to the needle bar during a period in which the embroidery hoop is movable in accordance with needle position data output from the sewing machine via the connector. The embroidery device can be connected to the sewing machine to transmit and receive data via the single terminal of the sewing machine used for connection to the foot controller. The embroidery device has a simplified structure that enables connection and data transmissions with the sewing machine using the connector, compared with a known embroidery device that requires a plurality of connectors.

A third aspect of the disclosure provides a non-transitory computer readable storage medium storing a sewing machine program, executable by a computer of a sewing machine. The sewing machine program causes the computer to perform operations including: receiving speed data from a foot controller connected to the sewing machine via a single terminal of the sewing machine, wherein the single terminal is for connecting the foot controller to the sewing machine and is configured to, when the foot controller is not connected to the sewing machine, allow connection of an external device to the sewing machine; controlling a sewing machine motor of the sewing machine in accordance with the speed data received; receiving input data from the external device connected to the sewing machine via the single terminal; and outputting output data to the external device connected to the sewing machine via the single terminal. The sewing machine program that is executed by the controller of the sewing machine achieves the same effects as the sewing machine according to the first aspect of the disclosure.

DETAILED DESCRIPTION

Figure 1A:
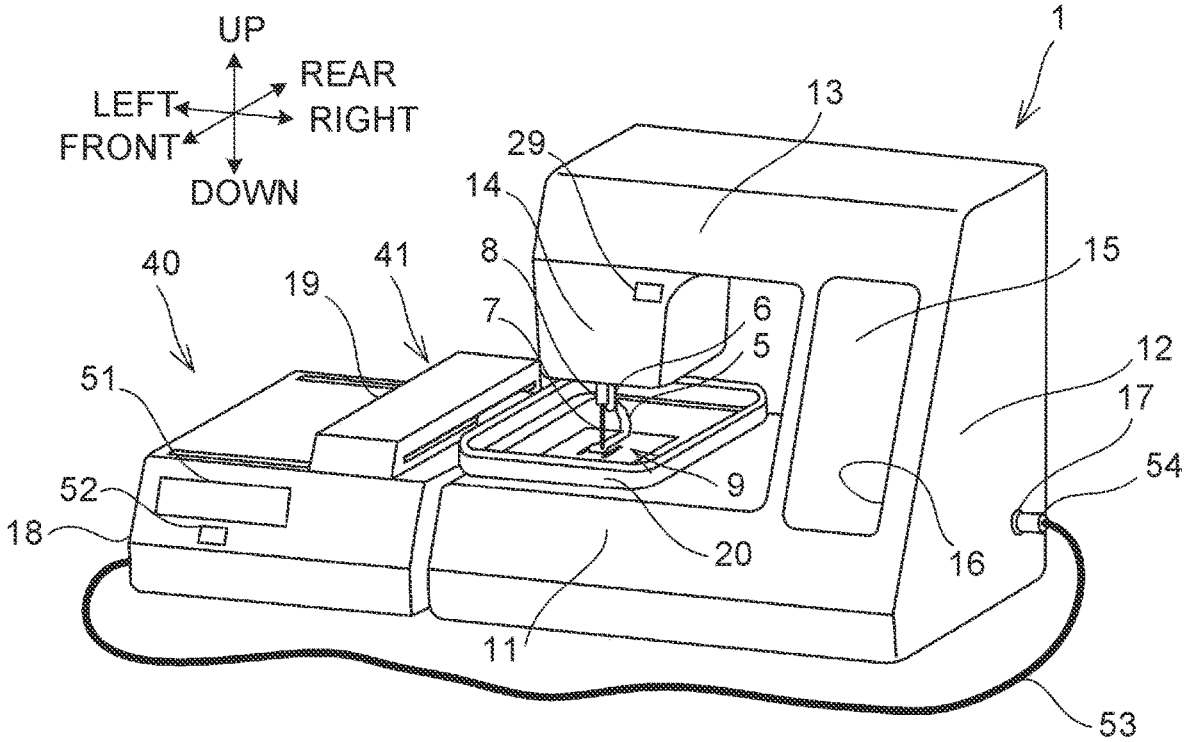
FIG. 1A is a perspective view of a sewing machine and an embroidery device connected to the sewing machine.

An embodiment of the disclosure will be described with reference to the drawings. Physical configurations of a sewing machine 1, an embroidery device 40, and a foot controller 90 will be described with reference to FIGS. 1A and 1B. An up-down direction, a lower left side, an upper right side, an upper left side, and a lower right side in each of FIGS. 1A and 1B indicate an up-down direction, a front side, a rear side, a left side, and a right side of the sewing machine 1 and the embroidery device 40, respectively. A longitudinal direction of a bed 11 and an arm 13 is a left-right direction of the sewing machine 1. The side on which the upright arm 12 is disposed is the right side. A direction in which the upright arm 12 extends is the up-down direction of the sewing machine 1. In FIG. 1B, a presser foot is omitted.

Figure 1B:
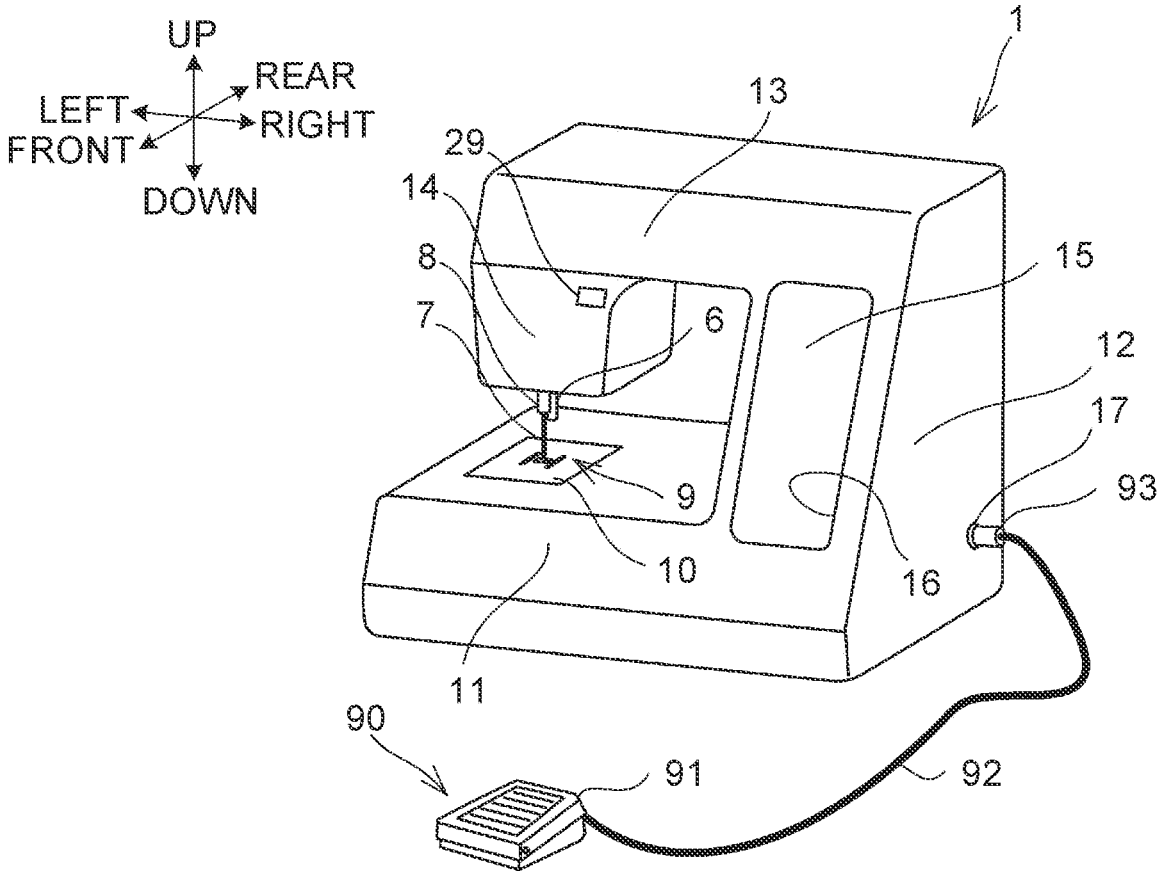
FIG. 1B is a perspective view of the sewing machine and a foot controller connected to the sewing machine.

As illustrated in FIGS. 1A and 1B, the sewing machine 1 includes a bed 11, an upright arm 12, an arm 13, a head 14, and a sewing unit 9. The bed 11 is a base of the sewing machine 1 that extends in the left-right direction. The bed 11 includes a needle plate 10. The sewing machine 1 includes a lower shaft, a feed mechanism, a retraction mechanism, and a shuttle mechanism in the bed 11. The feed mechanism includes a feed dog. The feed dog moves a workpiece backward or forward during sewing of a utility stitch pattern. The retraction mechanism retracts the feed dog below an upper surface of the needle plate 10 during embroidery sewing. The shuttle mechanism having a known configuration is driven with the rotation of the lower shaft. The upright arm 12 extends upward from a right end of the bed 11. The upright arm 12 has, on its front surface, an LCD 15 and a touch screen 16.

The sewing machine 1 includes a terminal 17 on a right surface of the upright arm 12. The terminal 17 is a terminal for connecting the foot controller 90 to the sewing machine 1. The terminal 17 can be used for connecting an external device to the sewing machine 1 to which the foot controller 90 is not connected. FIG. 1A illustrates that the embroidery device 40 is connected to the sewing machine 1 as an external device, and FIG. 1B illustrates that the foot controller 90 is connected to the sewing machine 1. The foot controller 90 includes a pedal 91, a cord 92, and a connector 93. The foot controller 90 changes the sewing speed of the sewing machine 1 by outputting speed data, which corresponds to how far the user depresses the pedal 91, to the sewing machine 1, in addition to instructing the sewing machine 1 to start sewing when the user depresses the pedal 91.

The arm 13 faces the bed 11 and extends leftward from the upper end of the upright arm 12. The head 14 is connected to the left end of the arm 13. The sewing unit 9 includes a needle bar 8 and a sewing machine motor 37, and is configured to drive the needle bar 8 in the up-down direction with the power of the sewing machine motor 37 for forming stitches. A needle 7 is detachably attached to a lower end of the needle bar 8. A presser bar 6 is disposed behind the needle bar 8. A presser foot 5 is detachably attached to a lower end of the presser bar 6. A start/stop switch 29 is provided on the front surface of the head 14. The start/stop switch 29 is used to start or stop the operation of the sewing machine 1, that is, to input an instruction to start or stop sewing.

The embroidery device 40 includes a moving unit 41, an LCD 51, a switch 52, a cord 53, and a connector 54. The embroidery device 40 is disposed to the left of the sewing machine 1, and is configured to move a workpiece, which is held by an embroidery hoop 20, relative to the needle bar 8 when the connector 54 is electrically connected to the terminal 17 of the sewing machine 1. The moving unit 41 is configured to move the embroidery hoop 20, which holds the workpiece taut, relative to the needle bar 8. The moving unit 41 includes a main body case 18 and a carriage 19. The main body case 18 houses an X-movement mechanism (not shown) that includes an X-axis motor 81 (refer to FIG. 2) for moving the embroidery hoop 20 in the left-right direction. The carriage 19 houses a Y movement mechanism (not shown) that includes a Y-axis motor 82 (refer to FIG. 2) for moving the embroidery hoop 20 in the front-rear direction. At the time of embroidery sewing, the user attaches one embroidery hoop 20 selected from a plurality of types of embroidery hoops having different sizes to the carriage 19. The embroidery hoop 20 is moved by the Y movement mechanism and the X movement mechanism to a needle drop point indicated by an XY coordinate system (embroidery coordinate system) specific to the embroidery device 40. The needle drop point is a point at which the needle 7 attached to the sewing machine 1 drops when the sewing unit 9 is driven. The sewing machine 1 forms an embroidery pattern on the workpiece held by the embroidery hoop 20 by driving the sewing unit 9 in conjunction with the movement of the embroidery hoop 20 by the embroidery device 40.

Figure 2:
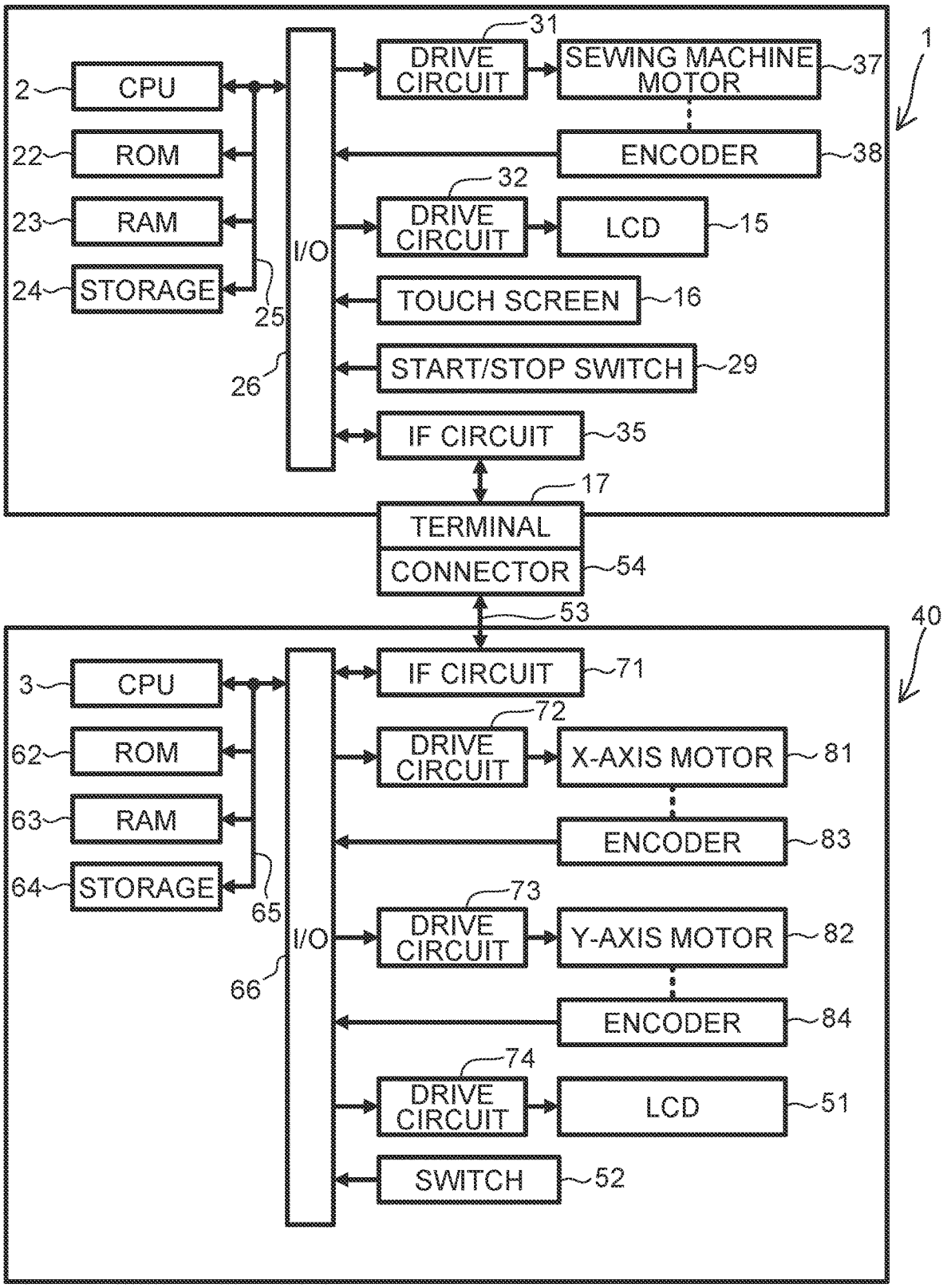
FIG. 2 is a block diagram illustrating an electrical configuration of the sewing machine and the embroidery device connected to the sewing machine.

Referring to FIG. 2, an electrical configuration of the sewing machine 1 and the embroidery device 40 will be described. The sewing machine 1 includes a CPU 2, a ROM 22, a RAM 23, a storage 24, and an input/output (I/O) interface 26. The CPU 2 is connected via a bus 25 to the ROM 22, the RAM 23, the storage 24 and the I/O interface 26. The I/O interface 26 is connected to drive circuits 31 and 32, an encoder 38, a touch screen 16, a start/stop switch 29, and an IF circuit 35. The storage 24 stores various setting values. The CPU 2 is configured to control the sewing unit 9.

The drive circuit 31 is connected to the sewing machine motor 37. The drive circuit 31 drives the sewing machine motor 37 in accordance with a control signal from the CPU 2. As the sewing machine motor 37 is driven, a needle bar drive mechanism of the sewing unit 9 is driven, and the needle bar 8 is driven in the up-and-down direction. The encoder 38 detects a rotation position and a rotation speed of an output shaft of the sewing machine motor 37 and inputs a detection result to the I/O interface 26. The CPU 2 specifies the position of the needle bar 8 in the up-down direction using the detection result of the encoder 38. The drive circuit 32 allows the LCD 15 to display an image in accordance with a control signal from the CPU 2. The IF circuit 35 is electrically connected to the terminal 17.

The embroidery device 40 includes a CPU 3, a ROM 62, a RAM 63, a storage 64 and an input/output (I/O) interface 66. The CPU 3 is connected via a bus 65 to the ROM 62, the RAM 63, the storage 64 and the I/O interface 66. The I/O interface 66 is connected to an IF circuit 71, drive circuits 72, 73, and 74, encoders 83 and 84, and a switch 52. The storage 64 stores various setting values. The storage 64 stores a plurality of sewing data each corresponding to a pattern that is candidate for a pattern to be sewn by the embroidery device 40. The sewing data includes coordinate data. The coordinate data represents coordinates of needle drop points for forming a plurality of stitches for an embroidery pattern in an embroidery coordinate system of the embroidery device 40. The CPU 3 is configured to control the moving unit 41.

The IF circuit 71 is electrically connected to the terminal 17. The drive circuit 72 is connected to the X-axis motor 81. The drive circuit 73 is connected to the Y-axis motor 82. The drive circuit 72 drives the X-axis motor 81 in accordance with a control signal from the CPU 2, and drive circuit 73 drives the Y-axis motor 82 in accordance with a control signal from the CPU 2. As the X-axis motor 81 and the Y-axis motor 82 are driven, the embroidery hoop 20 attached to the embroidery device 40 moves in the left-right direction (X direction) and the front-rear direction (Y direction) by a movement amount corresponding to the control signal. The encoder 83 detects a rotation position and a rotation speed of an output shaft of the X-axis motor 81 and inputs detection results to the I/O interface 66. The encoder 84 detects a rotation position and a rotation speed of an output shaft of the Y-axis motor 82 and inputs detection results to the I/O interface 66. The switch 52 detects various instructions and inputs detection results to the I/O interface 66. The CPU 3 specifies a current position of the embroidery hoop 20 in the embroidery coordinate system using the detection results of the encoder 83, 84.

Figure 3:
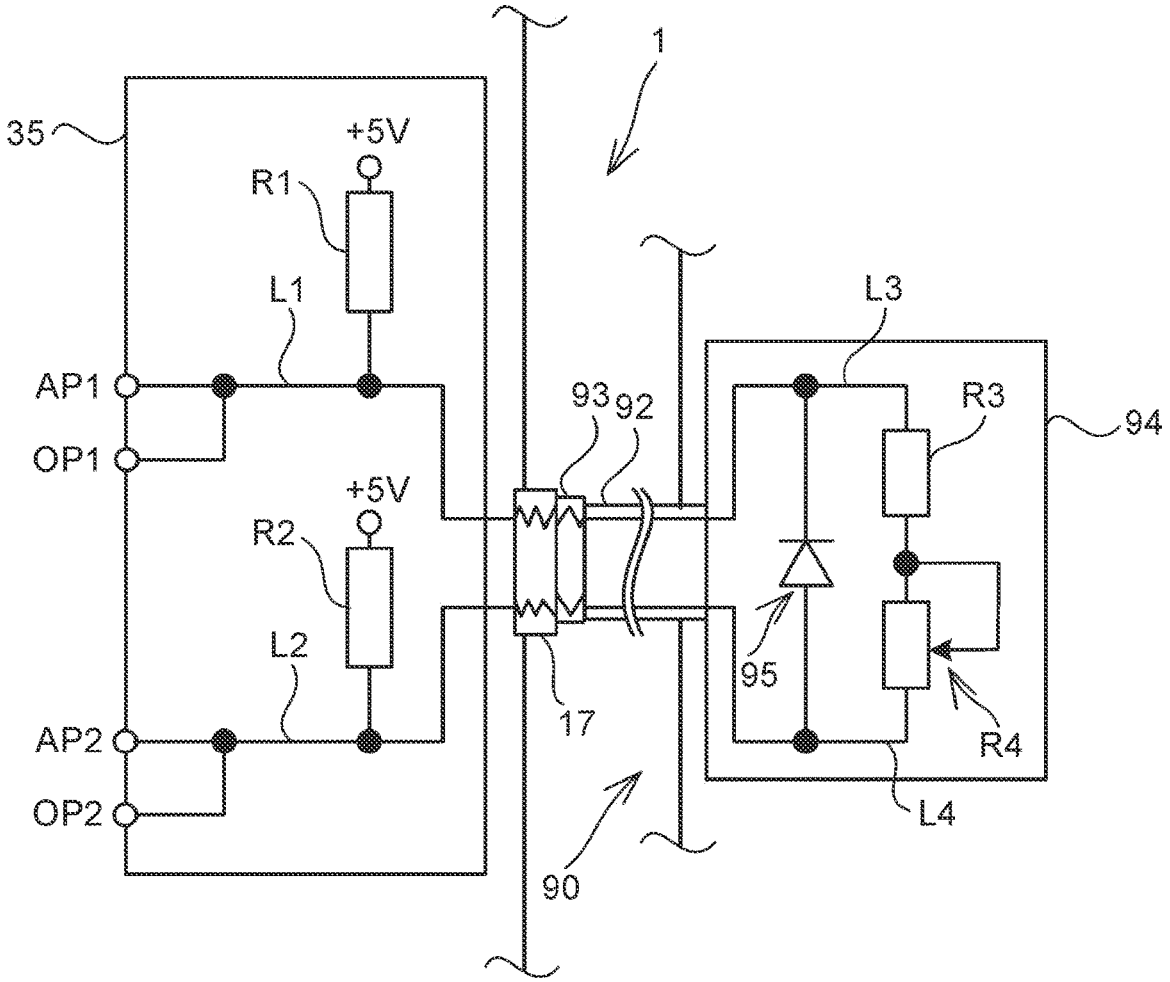
FIG. 3 is a diagram of an IF circuit of the sewing machine and an IF circuit of the foot controller connected via a terminal of the sewing machine.

Referring to FIG. 3, the IF circuit 35 of the sewing machine 1 and the IF circuit 94 of the foot controller 90 will be described. The IF circuit 35 includes an analog port AP1, an analog port AP2, an output port OP1, an output port OP2, a power supply line L1, a ground line L2, a pull-up resistor R1, and a pull-up resistor R2. The power supply line L1 is connected to the analog port AP1, and carries +5V via the pull-up resistor R1 (e.g., about 4.7 kΩ). The ground line L2 carries +5V via the pull-up resistor R2 (e.g., about 200Ω). The output port OP1 is connected to the analog port AP1, and the output port OP2 is connected to the analog port AP2.

The IF circuit 94 of the foot controller 90 includes a power supply line L3, a ground line L4, a diode 95, a resistor R3, and a variable resistor R4. The diode 95 that is used for rectification is located between the power supply line L3 and the ground line L4 such that its cathode is connected to the power supply line L3 and its anode is connected to the ground line L4, and connected in parallel with the resistor R3 (e.g., about 1 kΩ) and the variable resistor R4 (e.g., maximum resistance value: about 50 kΩ). The variable resistor R4 has a resistance value that varies in a range from approximately 0Ω to approximately 50 kΩ in accordance with how far the user depresses the pedal 91 (refer to FIG. 1). The power supply line L3 is connected to the analog port AP1 via the connector 93, the terminal 17, and the power supply line L1. The power supply line L4 is connected to the analog port AP2 via the connector 93, the terminal 17, and the power supply line L2.

Figure 4:
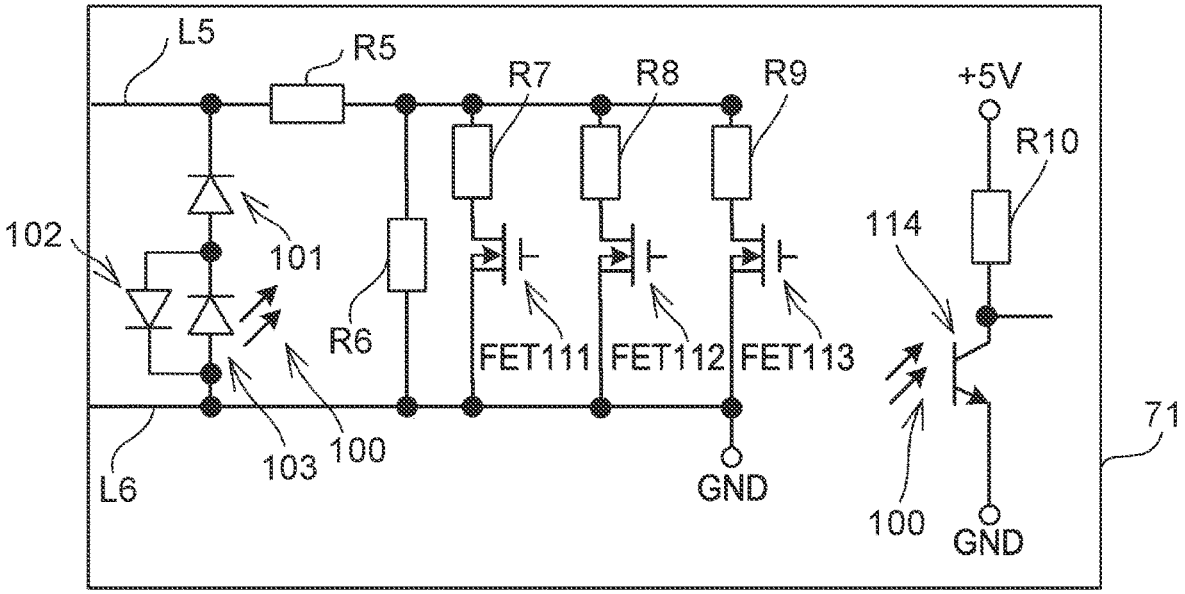
FIG. 4 is a diagram of an IF circuit of the embroidery device.

Referring to FIG. 4, the IF circuit 71 of the embroidery device 40 will be described. The IF circuit 71 includes a power supply line L5, a ground line L6, diodes 101 and 102, a photocoupler 100, resistors R5 to R10, and field-effect transistors (FETs) 111, 112, and 113. The photocoupler 100 is composed of a light emitting element 103 such as a light emitting diode and a light receiving element 114 such as a transistor. The diode 101 and the light emitting element 103 are located between the power supply line L5 and the ground line L6 such that their cathodes face toward the power supply line L5 and their anodes face toward the ground line L6. The diode 102 is connected in parallel with the light emitting element 103 in a direction opposite to the light emitting element 103. The diode 102 is provided for reverse voltage protection of the photocoupler 100.

The resistor R6 (e.g., about 50 kΩ) is located in parallel with the diodes 101 and 102 and the light emitting element 103 between the power supply line L5 and the ground line L6. The resistor R5 (e.g., about 1 kΩ) is located on the power supply line L5 and between the diode 101 and the resistor R6. The resistors R7 and the FET 111 are located in parallel with the resistor R6 between the power supply line L5 and the ground line L6. The resistors R8 and the FET 112 are located in parallel with the resistor R6 between the power supply line L5 and the ground line L6. The resistors R9 and the FET 113 are located in parallel with the resistor R6 between the power supply line L5 and the ground line L6. The ground line L6 is grounded between the FET 112 and the FET 113. The light receiving element 114 carries +5V at one end via a pull-up resistor R10 (e.g., about 4.7 kΩ). The light receiving element 114 is grounded at the other end.

The embroidery device 40 outputs four kinds of speed data to the sewing machine 1 according to states of the FETs 111 to 113 between ON and OFF. When the FETs 111 to 113 are all OFF, the embroidery device 40 outputs zero sewing speeds, that is, an instruction to stop sewing, to the sewing machine 1. When the FET 111 is ON and the FETs 112 and 113 are OFF, the embroidery device 40 outputs, to the sewing machine 1, speed data indicating a low speed (e.g., a predetermined value within a range of 50 to 100 stitches per minute). When the FET 111 and the FET 112 are ON and the FET 113 is OFF, the embroidery device 40 outputs, to the sewing machine 1, speed data indicating a medium speed (e.g., a predetermined value within a range of 100 to 200 stitches per minute). When the FETs 111 to 113 are all ON, the embroidery device 40 outputs, to the sewing machine 1, speed data indicating a high speed (e.g., a predetermined value within a range of 200 to 500 stitches per minute). The CPU 3 of the embroidery device 40 detects a pulse width or pulse cycle of a pulse signal output from the sewing machine 1 using the photocoupler 100 to receive needle position data.

Figure 5:
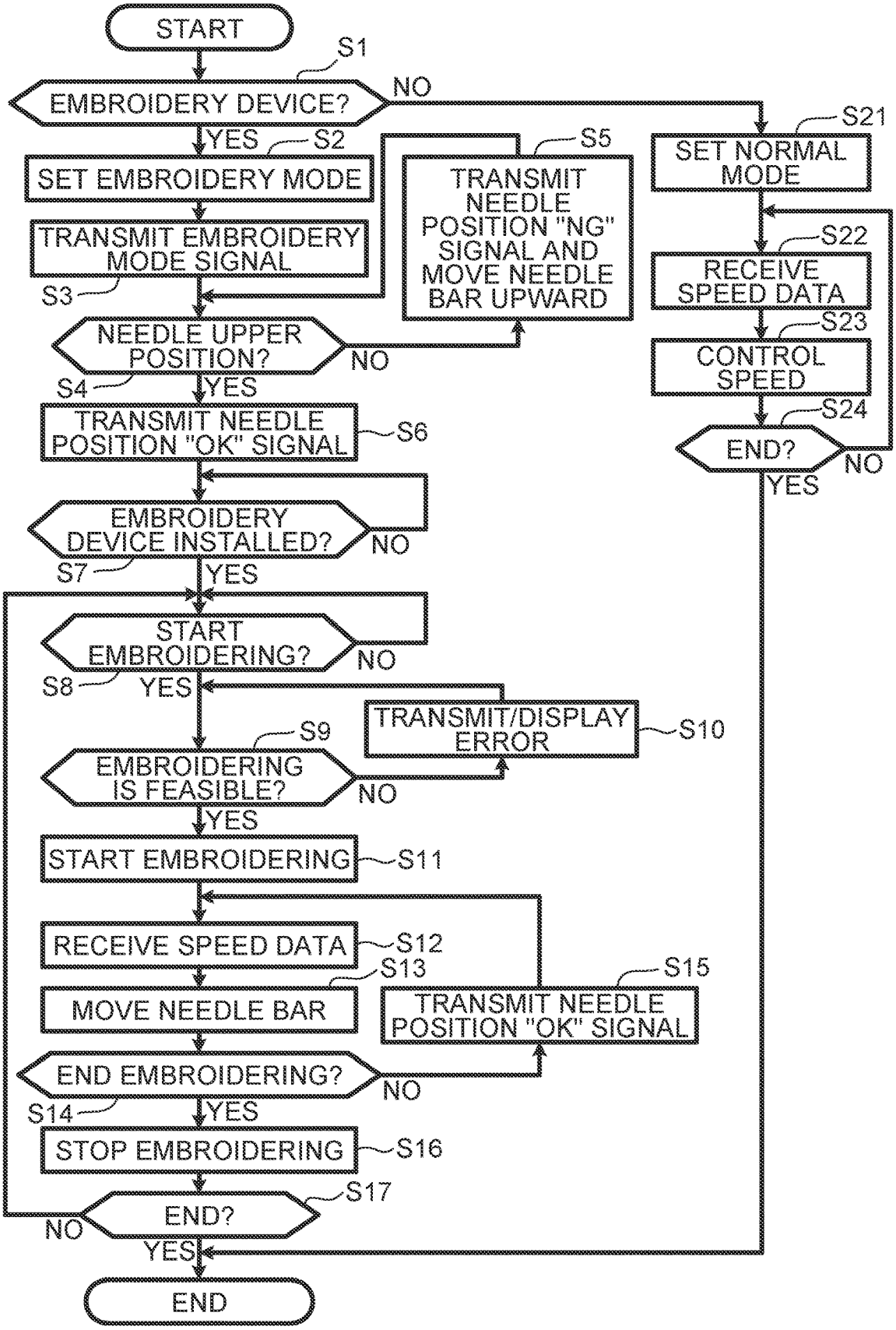
FIG. 5 is a flowchart of a main process of the sewing machine.
Figure 6:
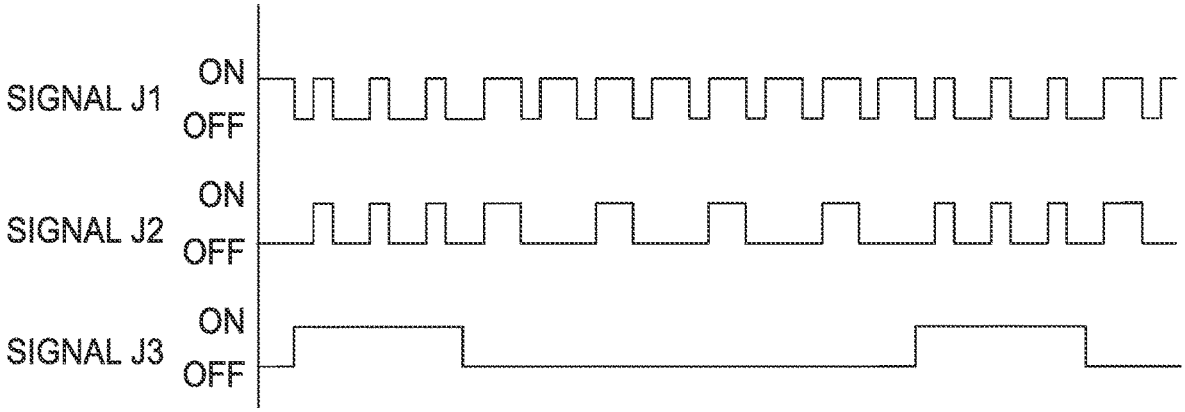
FIG. 6 illustrates needle position data to be output from the sewing machine to the embroidery device.

Referring to FIGS. 5 and 6, a main process performed at the sewing machine 1 will be described. In the main process, operations related to a device with a connector connected to the terminal 17 are performed. When the connector 54 of the embroidery device 40 is connected to the terminal 17, the sewing machine 1 performs embroidering an embroidery pattern on a workpiece held by the embroidery hoop 20 in cooperation with the embroidery device 40, in accordance with the main process. The embroidery device 40 receives sewing data indicating a formation position of the embroidery pattern from the storage 64 in response to an instruction from the user. Sewing the embroidery pattern is started by pressing the start/stop switch 29 of the sewing machine 1 or the switch 52 of the embroidery device 40. The CPU 2 starts the main process in response to detecting a start signal indicating that the user has connected the connector 93 of the foot controller 90 or the connector 54 of the embroidery device 40 to the terminal 17. In response to detecting the start signal, the CPU 2 reads a program for performing the main process stored in a program storage area of the ROM 22 into the RAM 23. The CPU 2 performs the following steps in accordance with instructions included in the program read into the RAM 23. Hereinafter, step will be abbreviated as S. Various parameters used for performing the main process are stored in the storage 24. Various kinds of data received in the main process are stored in the RAM 23 as appropriate. When the connector 93 of the foot controller 90 is connected to the terminal 17, the foot controller 90 can input the speed data to the sewing machine 1 via the terminal 17. When the connector 54 of the embroidery device 40 is connected to the terminal 17, the sewing machine 1 and the embroidery device 40 can perform data input and output via the terminal 17.

The CPU 2 determines whether the connector 93 of the foot controller 90 or the connector 54 of the embroidery device 40 is connected to the terminal 17 (S1). The CPU 2 determines that the connector 54 of the embroidery device 40 is connected in response to detecting a signal obtained by changing an analog voltage output at S31 described later according to a predetermined rule. When the connector 93 of the foot controller 90 is connected to the terminal 17 (S1: NO), the CPU 2 sets a normal mode (S21). In the normal mode, the CPU 2 deactivates the start/stop switch 29 to input an instruction. The CPU 2 does not drive the retraction mechanism and allows the feed dog to transfer the workpiece. Until the CPU 2 receives an end instruction (S24: NO), the CPU 2 continues to receive the speed data for controlling the sewing speed from the foot controller 90 via the terminal 17 (S22). The value of the voltage output to the sewing machine 1 changes as the resistance value of the variable resistor R4 of the IF circuit 94 changes in accordance with how far the pedal 91 of the foot controller 90 is depressed. The CPU 2 receives speed data by detecting a sewing speed using a voltage output from the foot controller 90. The CPU 2 controls the sewing machine motor 37 in accordance with the received speed data (S23). To end the main process, the user of the sewing machine 1 inputs an end instruction on the touch screen 16. In response to receiving the end instruction (S24: YES), the CPU 2 ends the main process.

When the connector 54 of the embroidery device 40 is connected to the terminal 17 (S1: YES), the CPU 2 sets an embroidery mode (S2). In the embroidery mode, the sewing machine 1 activates the start/stop switch 29 to input an instruction. The sewing machine 1 drives the retraction mechanism to move the feed dog below the needle plate 10, thereby disabling transferring the workpiece by the feed dog. The CPU 2 transmits a signal indicating that the embroidery mode has been set to the embroidery device 40 via the terminal 17, the connector 54, and the cord 53 (S3). The CPU 2 outputs various signals to the embroidery device 40 according to patterns of a pulse signal switched between ON and OFF. Specifically, as illustrated in FIG. 6, the CPU 2 changes a duty ratio like a signal J1, changes a cycle like a signal J2, or combines the change of the duty ratio and the change of the cycle, and outputs various signals as output data from the sewing machine 1 to the embroidery device 40.

When the connector 54 of the embroidery device 40 is connected to the terminal 17, the CPU 2 determines whether the position of the needle 7 in the up-down direction satisfies a predetermined criterion that the needle 7 is located above the needle plate 10 (S4). More particularly, the CPU 2 determines whether the current position of the lower end of the needle 7 in the up-down direction is at a needle upper position that is above the needle plate 10 and above the embroidery hoop 20 based on output results of the encoder 38 (S4). In response to determining that the position of the needle 7 in the up-down direction does not satisfy the predetermined criterion (S4: NO), the CPU 2 transmits an NG signal indicating that the position of the needle 7 in the up-down direction does not satisfy the sewing start condition, that is, the needle 7 is at a needle lower position below the upper end of the embroidery hoop 20, to the embroidery device 40 via the terminal 17, the connector 54, and the cord 53, and moves the needle bar 8 upward until the position of the needle 7 in the up-down direction satisfies the predetermined criterion (S5). The CPU 2 may control the LCD 15 to display a message prompting the user to raise the needle bar 8 before starting the operation of raising the needle bar 8. The CPU 2 may perform the operation of S5 in response to receiving a movement instruction from the user or the embroidery device 40. The CPU 2 returns the operation to S4. In this manner, in response to determining that the position of the needle 7 in the up-down direction does not satisfy a predetermined criterion (S4: NO), the CPU 2 does not start a sewing-control operation. When the needle 7 is at the needle upper position (S4: YES), the CPU 2 transmits an OK signal indicating that the position of the needle 7 in the up-down direction satisfies the sewing start condition to the embroidery device 40 (S6). As illustrated by a signal J3 in FIG. 6, the CPU 2 interprets the OK signal as an ON signal and the NG signal as an OFF signal.

The CPU 2 waits until it receives an installation completion signal indicating that the embroidery device 40 has been installed from the embroidery device 40 via the connector 54 and the terminal 17 (S7: NO). In response to receiving the installation completion signal (S7: YES), the CPU 2 determines whether it receives an instruction to start embroidering (S8). In response to detecting pressing of the start/stop switch 29, the CPU 2 determines that it has received an instruction to start embroidering, and transmits a start signal to the embroidery device 40 via the terminal 17 and the connector 54. Alternatively, the CPU 2 determines that it has received the instruction to start embroidering in response to detecting the start signal transmitted from the embroidery device 40 by pressing of the switch 52. The CPU 2 waits until it receives the instruction to start embroidering stands by until an instruction to start embroidering (S8: NO). In response to receiving the instruction to start embroidering (S8: YES), the CPU 2 determines whether embroidering is feasible (S9). The CPU 2 determines that embroidering is infeasible when there is no upper thread, there is no lower thread, or the upper end of the feed dog is above the needle plate 10. When the embroidering is infeasible (S9: NO), the CPU 2 transmits an error to the embroidery device 40, allows the LCD 15 to display a description on the error (S10), and returns the operation to S9. The user reads the description on the error displayed on LCD 15, and performs an operation to cancel the error.

When the embroidering is feasible (S9: YES), the CPU 2 transmits a signal to start embroidering to the embroidery device 40 (S11). The CPU 2 receives speed data outputted from the embroidery device 40 (S12). At S12, the CPU 2 receives the speed data by detecting the sewing speed using the voltage output from the embroidery device 40 in the same manner as the operation of S22. The CPU 2 drives the sewing machine motor 37 at a speed corresponding to the speed data received at S12, moves the needle bar 8 from the upper end position to the lower end position in its movable range, and then returns the needle bar 8 to the upper end position again (S13). By repeating operations of S12 to S15, the CPU 2 controls the sewing unit 9 in synchronization with the moving unit 41 of the embroidery device 40 in accordance with the speed data to embroider the embroidery pattern on the workpiece.

The CPU 2 determines whether to end embroidering in accordance with the speed data output from the embroidery device 40 (S14). When the speed data is data indicating a stop of sewing, the CPU 2 determines to end embroidering. In response to determining not to end embroidering (S14: NO), the CPU 2 outputs needle position data corresponding to the position of the needle 7 in the up-down direction to the embroidery device 40 (S15), and returns the operation to S12. At S15 different from the operations of S5 and S6, the CPU 2 interprets the needle position data indicating that the lower end of the needle 7 is above the upper end of the needle plate 10 as an OK signal, and interprets the needle position data indicating that the lower end of the needle 7 is below the upper end of the needle plate 10 as an NG signal.

In response to determining to end embroidering (S14: YES), the CPU 2 stops driving the sewing machine motor 37 (S16), and determines whether an instruction to end the main process has been received (S17). When the instruction to end the main process has not been received (S17: NO), the CPU 2 returns the operation to S8. To end the main process, the user of the sewing machine 1 inputs an end instruction on the touch screen 16. In response to receiving the end instruction (S17: YES), the CPU 2 ends the main process.

Figure 7:
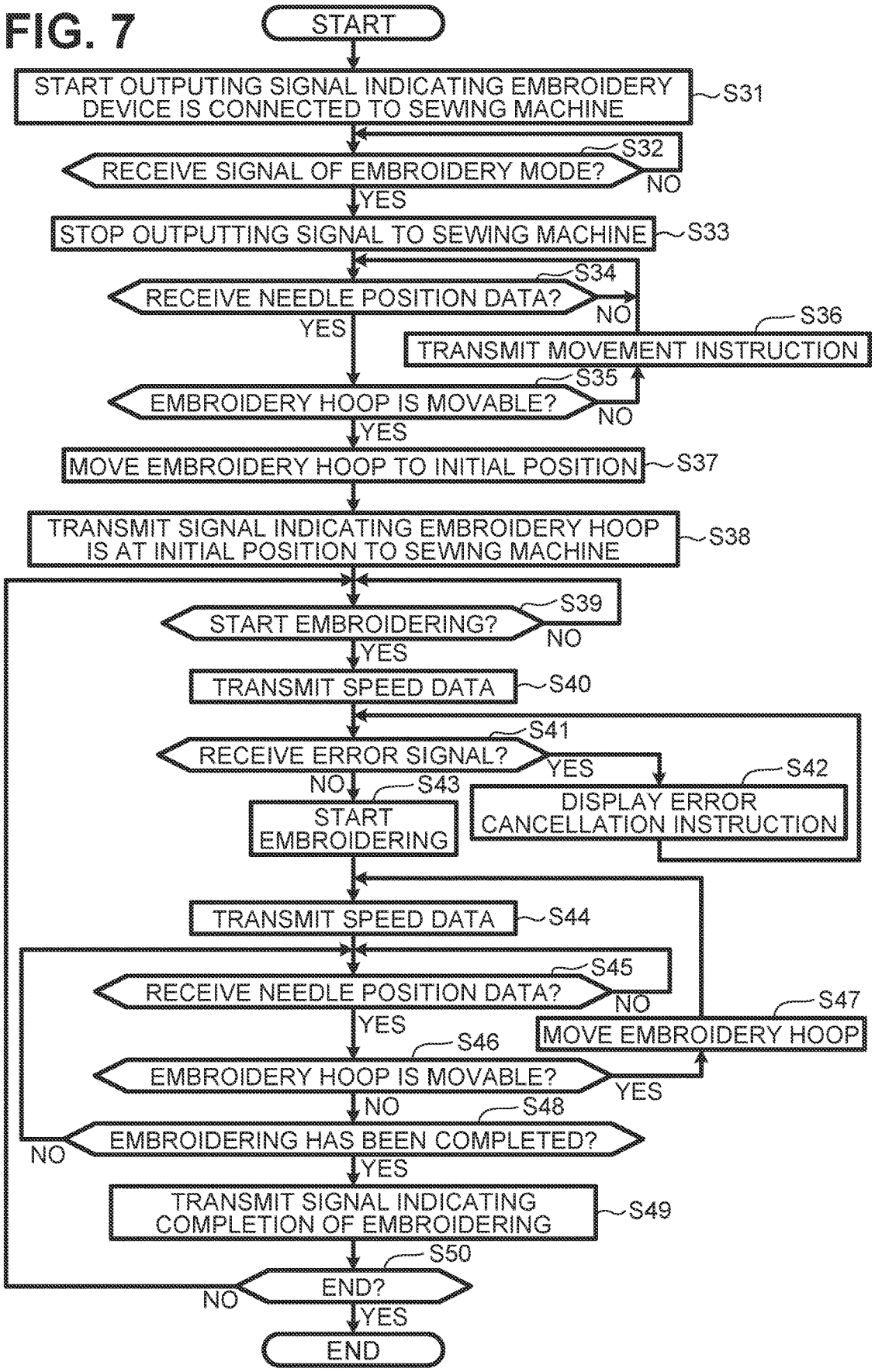
FIG. 7 is a flowchart of a main process of the embroidery device.

Referring to FIG. 7, a main process performed at the embroidery device 40 will be described. In the main process, operations for embroidering an embroidery pattern on a workpiece held by the embroidery hoop 20 in cooperation with the sewing machine 1 are performed. The CPU 3 starts the main process in response to detecting a start signal indicating that the user has connected the connector 54 of the embroidery device 40 to the terminal 17. In response to detecting the start signal, the CPU 3 reads a program for performing the main process stored in a program storage area of the ROM 62 into the RAM 63. The CPU 3 performs the following steps in accordance with instructions included in the program read into the RAM 63. Hereinafter, step will be abbreviated as S. Various parameters used for performing the main process are stored in the storage 64. Various kinds of date received in the main process are stored in the RAM 63 as appropriate.

As illustrated in FIG. 7, the CPU 3 starts an operation for outputting a signal indicating that the embroidery device 40 is connected to the sewing machine 1 to the sewing machine 1 (S31). The CPU 3 outputs a signal indicating that the embroidery device 40 is connected to the sewing machine 1 by outputting a signal obtained by changing an analog voltage according to a predetermined rule via the connector 54 and the terminal 17. The CPU 3 waits until it receives a signal indicating that the embroidery mode has been set in the sewing machine 1 from the sewing machine 1 (S32: NO).

The photocoupler 100 of the IF circuit 71 outputs a pulse signal to the CPU 3 in accordance with output data corresponding to a combination of on and off signals of an analog voltage output from the sewing machine 1. The CPU 3 detects a pulse width or pulse cycle of the pulse signal received via the photocoupler 100, and determines what the data output from the sewing machine 1 represents based on the detected results. In response to receiving a signal indicating that the embroidery mode has been set from the sewing machine 1 (S32: YES), the CPU 3 stops the operation started at S31 (S33). The CPU 3 waits until it receives the needle position information in accordance with the data output from the sewing machine 1 (S34: NO). In response to receiving the needle position data (S34: YES), the CPU 3 determines whether the embroidery hoop 20 is movable in accordance with the needle position data (S35). When the needle position signal is an NG signal (that is an OFF signal) (S35: NO), the CPU 3 transmits a movement instruction to raise the needle bar 8 to the needle upper position to the sewing machine 1 (S36), and returns the operation to S34. The CPU 3 transmits various instructions to the sewing machine 1 by outputting a signal obtained by changing an analog voltage according to a predetermined rule via the connector 54 and the terminal 17. Instead of transmitting the movement instruction, the CPU 3 may allow the LCD 51 to display a message prompting the user to raise the needle bar 8 to a position at which the embroidery hoop 20 can move as S36.

When the needle position data is an OK signal (that is an ON signal) (S35: YES), the CPU 3 controls the drive circuits 72 and 73 to move the embroidery hoop 20 to an initial position of the embroidery hoop 20 that the sewing data indicates (S37). Based on the detection results of the encoders 83 and 84, the CPU 3 determines whether the embroidery hoop 20 has been moved to the initial position indicated in the sewing data. After moving the embroidery hoop 20 to the initial position, the CPU 3 outputs a signal indicating that the embroidery hoop 20 is at the initial position to the sewing machine 1 (S38).

The CPU 3 waits until it detects an instruction to start embroidering (S39: NO). In response to receiving the start signal transmitted from the sewing machine 1 upon pressing of the start/stop switch 29, the CPU 3 determines that it has received the instruction to start embroidering. Alternatively, in response to detecting the start signal transmitted from the embroidery device 40 upon pressing of the switch 52, the CPU 3 determines that it has received the instruction to start embroidering, and transmits the start signal to the sewing machine 1 via the connector 54 and the terminal 17. In response to detecting the instruction to start embroidering (S39: YES), the CPU 3 transmits speed data to the sewing machine 1 (S40).

The CPU 3 determines whether it has received an error signal output from the sewing machine 1 (S41). In response to receiving the error signal (S41: YES), the CPU 3 allows the LCD 51 to display an error cancellation instruction (S42). In response to the error cancellation instruction, the CPU 3 allows the LCD 51 to display a message prompting the user to cancel the error. The CPU 3 returns the operation to S41. In response to not receiving the error signal (S41: NO), the CPU 3 starts embroidering (S43).

The CPU 3 transmits speed data to the sewing machine 1 (S44). The CPU 3 waits until it receives the needle position data from the sewing machine 1 (S45: NO). In response to receiving the needle position data (S45: YES), the CPU 3 determines whether the embroidery hoop 20 is movable in the same manner as at S35 (S46). In response to determining that the embroidery hoop 20 is movable (S46: YES), the CPU 3 controls the drive circuits 72 and 73 to move the embroidery hoop 20 to a needle drop position indicated in the sewing data (S47). Through the operations of S45 to S47, the CPU 3 controls the moving unit 41 to move the embroidery hoop 20 relative to the needle bar 8 during a period in which the embroidery hoop 20 is movable, in accordance with the needle position data output from the sewing machine 1 via the connector 54. Based on the detection results of the encoders 83 and 84, the CPU 3 determines whether the embroidery hoop 20 has moved to the needle drop point indicated in the sewing data. The CPU 3 returns the operation to S44.

In response to determining that the embroidery hoop 20 is not movable (S46: NO), the CPU 3 determines whether embroidering has been completed in accordance with the sewing data (S48). In response to determining that the embroidery hoop 20 has not moved to the last needle drop point indicated in the sewing data, that is, embroidering has not been completed (S48: NO), the CPU 3 reads a next needle drop point indicated in the sewing data and returns the operation to S45. In response to determining that the embroidery hoop 20 has moved to the last needle drop point indicated in the sewing data (S48: YES), the CPU 3 transmits a signal indicating that embroidering has been completed to the sewing machine 1 (S49). The CPU 3 determines whether it has received an instruction to end the main process (S50). In response to not receiving the end instruction (S50: NO), the CPU 3 returns the operation to S39. In response to receiving the end instruction (S50: YES), the CPU 3 ends the main process.

Figure 8:
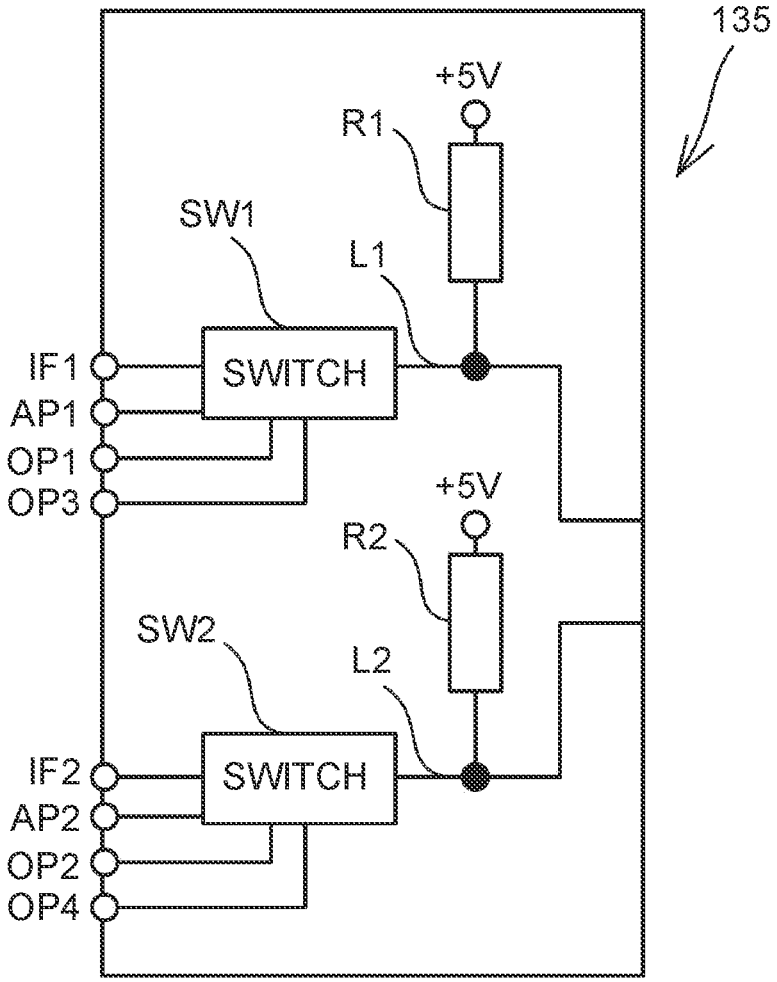
FIG. 8 is a diagram of an IF circuit of the sewing machine according to the modification.

Referring to FIG. 8, an IF circuit 135 which is a modification of the IF circuit 35 will be described. In FIG. 8, the same components as those of the IF circuit 35 are denoted by the same reference numerals, and descriptions thereof will be omitted below. As illustrated in FIG. 8, the IF circuit 135 includes an analog port AP1, an analog port AP2, a communication port IF1, a communication port IF2, an output port OP1, an output port OP2, an output port OP3, an output port OP4, a power supply line L1, a ground line L2, a pull-up resistor R1, a pull-up resistor R2, a switch SW1, and a switch SW2. The output port OP1 is connected to the analog port AP1, and the output port OP2 is connected to the analog port AP2.

The switch SW1 is connected to the analog port AP1, and switches connection of the IF circuit 135 to the CPU 2 of the sewing machine 1 between the analog port AP1 and the communication port IF1 in accordance with the detection result. The switch SW2 is connected to the analog port AP2, and switches connection of the IF circuit 135 to the CPU 2 of the sewing machine 1 between the analog port AP2 and the communication port IF2 in accordance with the detection result. The switches SW1 and SW2 are each configured by, for example, a FET, a logic IC, or other semiconductor device. The embroidery device 40 has components similar to the switches SW1 and SW2, and the communication ports IF1 and IF2. The communication ports IF1 and IF2 each include a general-purpose communication standard (UART, I2C, differential-signal), and enable two-way communication between the sewing machine 1 and the embroidery device 40. The output ports OP3 and OP4 are provided separately from the output ports OP1 and OP2 and are each used to output a signal for controlling the embroidery device 40.

The IF circuit 135 of the modification switches control circuits in the CPU 2 of the sewing machine 1 depending on whether the connector 93 of the foot controller 90 or the connector 54 of the embroidery device 40 is connected to the terminal 17. In the main process of the sewing machine 1 including the IF circuit 135 of the modification, the operations are performed by switching control circuits in the CPU 2 of the sewing machine 1 depending on whether the connector 93 of the foot-controller 90 or the connector 54 of the embroidery device 40 is connected to the terminal 17.

In the above-described embodiments, the sewing machine 1, the CPU 2, the needle 7, the needle bar 8, the sewing unit 9, the needle plate 10, the terminal 17, the start/stop switch 29, and the sewing machine motor 37 are examples of a sewing machine, a control unit, a needle, a needle bar, a sewing unit, a needle plate, a terminal, an input unit, and a sewing machine motor of the disclosure, respectively. The embroidery device 40, the moving unit 41, the CPU 3, the switch 52, and the embroidery hoop 20 are examples of an embroidery device, a moving unit, an embroidery control unit, an input unit, and an embroidery hoop of the disclosure, respectively. The foot controller 90 is an example of a foot controller of the disclosure. The operation of S22 is an example of a speed-data receiving operation of the disclosure. The operation of S23 is an example of a speed-control operation of the disclosure. The operations of S8 and S12 are each an example of an input-data receiving operation of the disclosure. The operations of S3, S5, S6, S10, and S15 are each an example of a data-outputting operation. A series of operations of S11 to S16 is an example of a sewing-control operation of the disclosure. The operation of S1 is an example of a device-determination operation of the disclosure. The operation of S39 is an example of an instruction-outputting operation of the disclosure. The operation of S4 is an example of a height-determination operation of the disclosure. The operation of S5 is an example of a moving operation of the disclosure.

The sewing machine 1 of the above-described embodiment includes the sewing unit 9, the terminal 17, and the CPU 2. The sewing unit 9 includes the needle bar 8 having the lower end to which the needle 7 is attachable, and the sewing machine motor 37. The sewing unit 9 drives the needle bar 8 in the up-down direction with power of the sewing machine motor 37 for forming stitches. The terminal 17 is a single terminal 17 for connecting the foot controller 90 to the sewing machine 1, and can be connected to the connector 54 of the embroidery device 40, which is an example of an external device, when the connector 93 of the foot controller 90 is not connected. When the connector 93 of the foot controller 90 is connected to the terminal 17, the CPU 2 receives speed data for controlling the sewing speed from the foot controller 90 via the terminal 17 (S22). The CPU 2 controls the sewing machine motor 37 in accordance with the speed data received at the operation of S22 (S23). When an external device is connected to the terminal 17 (S1: YES), the CPU 2 receives input data from the external device via the terminal 17 (S8, S12). When an external device is connected to the terminal 17 (S1: YES), the CPU 2 outputs output data to the external device via the terminal 17 (S3, S5, S6, S10, S15). The sewing machine 1 can perform, via the single terminal 17, data output to and data output from an external device such as the embroidery device 40.

As illustrated in FIG. 1A, when the external device connected via the terminal 17 is the embroidery device 40 including the moving unit 41, which moves the embroidery hoop 20 holding the workpiece relative to the needle bar 8, and the CPU 3, which controls the moving unit 41, the CPU 2 receives the speed data from the embroidery device 40 (S12). The CPU 2 controls the sewing unit 9 in synchronization with the moving unit 41 of the embroidery device 40 in accordance with the received speed data to embroider an embroidery pattern on the workpiece (in a sequence of processes from S11 to S16). The CPU 2 outputs needle position data corresponding to the position of the needle 7 in the up-down direction to the embroidery device 40 (S5, S6, S15). The sewing machine 1 can be connected to the embroidery device 40 for data communications by using the terminal 17 used for connection to the foot controller 90. The sewing machine 1 has a simplified structure that enables connection and data transmissions with the embroidery device 40 using the single terminal 17, compared with the known sewing machine that requires a plurality of terminals. If the embroidery device 40 is connected to the sewing machine 1 via, for example, a universal serial bus (USB) terminal, which is different from the terminal 17, input data needs to be controlled in accordance with the USB terminal. However, the sewing machine 1 is capable of inputting and outputting data that enables the sewing machine 1 to perform the main process in synchronization with the embroidery device 40 by inputting and outputting on and off signals of an analog voltage or signals into which an analog voltage is translated according to a predetermined rule to and from the embroidery device 40 via the terminal 17, thus eliminating complicated control.

The CPU 2 receives speed data by detecting a sewing speed using a voltage output from the foot controller 90 (S22). At S12, the CPU 2 receives the speed data by detecting the sewing speed using the voltage output from the embroidery device 40 in the same manner as the operation of S22. When the connector 54 of the embroidery device 40 is connected to the terminal 17, the sewing machine 1 can receives the sewing speed in the same manner as when the connector 93 of the foot controller 90 is connected to the terminal 17. The sewing machine 1 can thus receive the sewing speed by the same control in a case where the connector 93 of the foot controller 90 is connected to the terminal 17 and in a case where the connector 54 of the embroidery device 40 is connected to the terminal 17, and can establish connection with the embroidery device 40 via the terminal 17 with a simple structure.

The CPU 2 determines whether the connector 93 of the foot controller 90 or the connector 54 of the embroidery device 40 is connected to the terminal 17 (S1). The sewing machine 1 can determine whether the device connected to the terminal 17 is the foot controller 90 or an external device, and can easily perform control in accordance with the device connected to the terminal 17 based on the determination result.

The embroidery device 40 includes the switch 52 for the user to input an instruction to start sewing. In response to detecting the instruction input by the switch 52 (S39), the CPU 3 outputs the instruction to the sewing machine 1 as input data (S40). The CPU 2 receives the start instruction from the embroidery device 40 as input data (S8: YES), and starts embroidering at S11 in response to receiving the start instruction from the embroidery device 40. In response to the start instruction input from the embroidery device 40, the sewing machine 1 performs the operations of S12 to S15 synchronized with the embroidery device 40.

The sewing machine 1 includes the start/stop switch 29 for the user to input an instruction to start sewing. In response to detection an instruction input by the start/stop switch 29 (S8: YES), the CPU 2 starts embroidering (S11). In response to detecting the instruction input by the start/stop switch 29 (S8: YES), the CPU 2 outputs output data indicating to start driving the moving unit 41 to the embroidery device 40 (S11). The sewing machine 1 can output an instruction to start the moving unit 41 to the embroidery device 40 in response to an instruction input by the sewing machine 1, and can start the operations of S12 to S15 synchronized with the embroidery device 40.

The sewing machine 1 includes the needle plate 10 that is disposed below the needle bar 8. When the connector 54 of the embroidery device 40 is connected to the terminal 17, the CPU 2 determines whether the position of the needle 7 in the up-down direction satisfies the predetermined criterion that the needle 7 is located above the needle plate 10 (S4). In response to determining that the position of the needle 7 in the up-down direction does not satisfy the predetermined criterion (S4: NO), the CPU 2 does not start the sewing-control operation. In order to place the embroidery hoop 20 below the needle bar 8, the needle 7 is to be above the needle plate 10. When the connector 54 of the embroidery device 40 is connected to the terminal 17 and the CPU 2 determines that the position of the needle 7 in the up-down direction does not satisfy the predetermined criterion, the CPU 2 does not start the sewing-control operation. This can reduce the possibility that sewing starts in a state in which the embroidery hoop 20 is not disposed below the needle bar 8.

When the connector 54 of the embroidery device 40 is connected to the terminal 17, the CPU 2 determines whether the position of the needle 7 in the up-down direction satisfies the predetermined criterion for being above the needle plate 10 (S4). In response to determining that the position of the needle 7 in the up-down direction does not satisfy the predetermined criterion in the operation of S4, the CPU 2 allows the needle bar 8 to move upward until the position of the needle 7 in the up-down direction satisfies the predetermined criterion (S5). When the sewing machine 1 determines that the position of the sewing needle 7 in the up-down direction does not satisfy the predetermined criterion in a case where the connector 54 of the embroidery device 40 is connected to the terminal 17, the sewing machine 1 moves the needle bar 8 upward until the position of the sewing needle 7 in the up-down direction satisfies the predetermined criterion. This obviates the necessity for the user to move the needle bar 8 when setting the embroidery hoop 20.

The embroidery device 40 includes the connector 54, the moving unit 41, and the CPU 3. The connector 54 is connectable to the terminal 17 of the sewing machine 1. The moving unit 41 is configured to move the embroidery hoop 20, which holds a workpiece, relative to the needle bar 8. Based on the needle position data output from the sewing machine 1 via the connector 54, the CPU 3 controls the moving unit 41 to move the embroidery hoop 20 relative to the needle bar 8 during a period in which the embroidery hoop 20 is movable. The embroidery device 40 can be connected to the sewing machine 1 by using the terminal 17 used for connection with the connector 93 of the foot controller 90, and can transmit and receive data. The embroidery device 40 has a simplified structure that enables connection and data transmissions with the sewing machine 1 using the connector 54 compared with a known embroidery device that requires a plurality of connectors.

The sewing machine, the embroidery device, and the sewing machine program, which are related to the disclosure, are not limited to those described in the above-described embodiment, and various modifications may be made without departing from the scope of the present invention. For example, the following modifications may be appropriately added.

(A) The configurations of the sewing machine 1 and the embroidery device 40 may be modified as appropriate. The placement of the embroidery device 40 relative to the sewing machine 1 may be changed as appropriate. For example, the embroidery device 40 may be placed behind the sewing machine 1. Examples of the input unit of the sewing machine 1 and the input unit of the embroidery device 40 may include the touch screen 16, a keyboard, a mouse, and a joystick, in addition to the start/stop switch 29 and the switch 52. Examples of the LCDs 15, 51 may include an organic EL display, a plasma display, a plasma tube array display, and an electronic paper display using electrophoresis. The LCDs 15, 51 may be omitted if necessary. The sewing machine 1 may include a storage device in addition to the storage 24. The embroidery device 40 may include a storage device in addition to the storage 64. Example of the storage device may include a readable and writable removable medium such as a magnetic disk, a magneto-optical disk, an optical disk, or a semiconductor memory, and a non-portable storage device such as a built-in hard disk drive or a solid state drive (SSD). The sewing data of an embroidery pattern may be received from another device (e.g., a storage medium such as a USB memory, a smartphone, a tablet computer, or a PC) connected to the embroidery device 40 in a wired or wireless manner, or may be generated by the embroidery device 40. The sewing data may be received by the sewing machine 1 and output to the embroidery device 40 via the terminal 17 and the connector 54. Similarly to the embroidery device 40, the sewing machine 1 may receive the sewing data from another device connected to the sewing machine 1 in a wired or wireless manner. The sewing machine 1 may not include the encoder 38. In this case, the determination process using the position of the needle 7 in the up-down direction, for example, at S4 may be performed using a detection result of a sensor such as an infrared sensor, or using a calculation result based on the driving amount of the sewing machine motor 37 after the adjustment of the origin position of the needle bar 8.

Examples of the external device including the connector connectable to the terminal 17 may include an upper feed device, a stitch regulator, and a guard device, in addition to the embroidery device 40. The upper feed device and the stitch regulator are each mounted, for example, below the presser bar 6. The upper feed device includes an endless belt and a motor, and conveys a workpiece in contact with the belt by rotating the belt with the power of the motor. The upper feed device may receive the needle position data from the sewing machine 1 and output the speed data to the sewing machine 1. The stitch regulator includes a sensor that detects a movement amount of the workpiece, and outputs a signal corresponding to a detection result of the sensor to the sewing machine 1, thereby prompting the sewing machine 1 to form stitches having a length within a predetermined range. The guard device includes a transparent cover disposed around the sewing needle 7 so as to be openable and closable, and is a device for preventing the user from accidentally allowing their finger to come into contact with the reciprocating needle 7. The guard device includes a sensor that detects opening and closing of the transparent cover, and outputs a signal corresponding to a detection result of the sensor to the sewing machine 1. The sewing machine 1 does not drive the sewing machine motor 37 when the cover is open based on the detection result from the guard device. When the terminal 17 receives the connector of the external device, the sewing machine 1 normally disables the start/stop switch 29, but it is preferable that the start/stop switch 29 is not disabled when any one of the upper feed device, the stitch regulator, and the guard device is attached to the sewing machine 1.

(B) The program including the command for performing the main process of the sewing machine 1 in FIG. 5 may be stored in the storage device of the sewing machine 1 before the CPU 2 performs the program. Thus, the method of receiving the program, the path to the program, and the device storing the program may be changed as appropriate. The program performed by the CPU 2 may be received from another device via wired or wireless communication and stored in a storage device such as a flash memory. Example of the other device include a PC and a server connected via a network. The program including the command for performing the main process of the embroidery device 40 in FIG. 7 may be stored in the storage device of the embroidery device 40 before the CPU 3 performs the program.

(C) Each step of the main process of the sewing machine 1 is performed by the CPU 2, but some or all of the steps may be performed by another electronic device (e.g., an ASIC). Each step of the main process of the sewing machine 1 may be subjected to distributed processing by a plurality of electronic devices (e.g., a plurality of CPUs). When necessary, the order of the steps of the main process of the sewing machine 1 can be changed, some of the steps can be omitted, and a new step can be added. The scope of the disclosure includes an aspect in which an operating system (OS) running on the sewing machine 1 performs some or all of the steps of the main process in accordance with a command from the CPU 2. For example, the following modifications may be added to the main process of the sewing machine 1 as appropriate. Each step of the main process of the embroidery device 40 is performed by the CPU 3, but some or all of the steps may be performed by another electronic device (e.g., an ASIC). For example, the following modifications may be added to the main process of the sewing machine 1 and the main process of the embroidery device 40 as appropriate.

The needle position data corresponds to the position of the needle 7 in the up-down direction, and may, for example, represent the position of the needle 7 in the up-down direction linearly in a stepwise manner. The needle position data may be data represented by a duty ratio of the pulse signal or may be data represented by a cycle of the pulse signal. For example, for the needle position data represented by the duty ratio of the pulse signal, as in the signal J1 illustrated in FIG. 6, an ON signal may be shorter than the criterion and an OFF signal may be longer than the criterion when the lower end of the needle 7 is above the needle plate 10 and the upper end of the embroidery hoop 20, and the ON signal may be longer than the criterion and the OFF signal may be shorter than the criterion when the lower end of the needle 7 is below the upper end of the embroidery hoop 20. For example, for the needle position represented by the cycle of the pulse signal, as in the signal J2 illustrated in FIG. 6, a signal may have a shorter cycle than the criterion when the lower end of the needle 7 is above the needle plate 10 and above the upper end of the embroidery hoop 20, and may have a longer cycle than the criterion when the lower end of the needle 7 is below the upper end of the embroidery hoop 20. The above criterion may be preset as appropriate. The same needle position data may be preset at S6 and S15.

At least one of the sewing machine 1 and the external device such as the embroidery device 40 may receive data from the analog voltage received via the terminal 17 in a known method and the method may be changed as appropriate. For example, the CPU 2 of the sewing machine 1 may interpret a predetermined voltage A of analog voltages output from the external device as logic "0" and a predetermined voltage B different from the voltage A as logic "1", thereby recognizing a change in the voltage output from the external device as a digital signal. The CPU 2 may interpret a voltage greater than a threshold as logic "0" and a voltage less than the threshold as logic "1", thereby recognizing a change in voltage output from the external device as a digital signal. The predetermined voltages A and B and the threshold value may be appropriately preset. The CPU 2 may detect a sewing speed based on data, such as a change in the duty ratio and a change in the cycle of the pulse signal, other than the voltage value. The CPU 2 may skip the operation of S1. When the connector 54 of the embroidery device 40 is connected to the terminal 17, the CPU 2 may deactivate the start/stop switch 29 and receive the start instruction from the embroidery device 40 or the touch screen 16. The start instruction may be input from the sewing machine 1 or the embroidery device 40 simply. The CPU 2 may skip the operations of S4 and S5 as appropriate. The above-described modifications may be combined as appropriate as long as there is no contradiction. The techniques disclosed in the disclosure can be realized in various forms, such as a control method for a sewing machine, a control method for an embroidery device, a computer program for realizing the above-described methods, and a recording medium having the computer program recorded thereon.

While the disclosure has been described in detail with reference to the specific embodiment thereof, this is merely an example, and various changes, arrangements and modifications may be applied therein without departing from the spirit and scope of the disclosure.

What is claimed is:

1. A sewing machine comprising:

a sewing unit including a sewing machine motor and a needle bar having a lower end to which a needle is attachable, the sewing unit being configured to drive the needle bar with power of the sewing machine motor for forming stitches;

a single terminal for connecting a foot controller to the sewing machine, the single terminal being configured to, when the foot controller is not connected to the sewing machine, allow connection of an external device to the sewing machine; and a sewing machine controller configured to control the sewing unit, the sewing machine controller being configured to perform:

a speed-data receiving operation to receive speed data from the foot controller connected to the sewing machine via the single terminal for controlling a sewing speed;

a speed-control operation to control the sewing machine motor in accordance with the speed data received in the speed-data receiving operation;

an input-data receiving operation to receive input data from the external device connected to the sewing machine via the single terminal; and a data-outputting operation to output output data to the external device via the single terminal.

2. The sewing machine according to claim 1, wherein the external device includes an embroidery device, the embroidery device includes an embroidery hoop for holding a workpiece, a moving unit to move relative to the needle bar, and an embroidery-device controller configured to control the moving unit, wherein the sewing machine controller is configured to:

receive the speed data as the input data in the input-data receiving operation when the embroidery device is connected to the sewing machine via the single terminal;

control the sewing unit in synchronization with the moving unit of the embroidery device in accordance with the received speed data, thereby performing a sewing-control operation to embroider an embroidery pattern on the workpiece; and output, as the output data in the data-outputting operation, needle position data corresponding to a position of the needle in the up-down direction.

3. The sewing machine according to claim 2, wherein the sewing machine controller is configured to:

in the speed-data receiving operation, detect the sewing speed using a voltage output from the foot controller, thereby receiving the speed data; and in the input-data receiving operation, detect the sewing speed using a voltage output from the embroidery device, thereby receiving the speed data.

4. The sewing machine according to claim 2, wherein the sewing machine controller is configured to further perform a device-determination operation to determine, using a voltage, whether the foot controller is connected to the sewing machine via the single terminal or the embroidery device is connected to the sewing machine via the single terminal.

5. The sewing machine according to claim 2, wherein the embroidery device includes an input unit for a user to input an instruction to start sewing, wherein the embroidery-device controller is configured to perform an instruction-outputting operation to output the instruction as the input data to the sewing machine in response to detecting the instruction input through the input unit, and wherein the sewing machine controller is configured to:

in the input-data receiving operation, receive, as the input data, the instruction output from the embroidery device in the instruction output process; and in response to receiving the instruction from the embroidery device, start the sewing-control operation.

6. The sewing machine according to claim 2, further comprising an input unit for a user to input an instruction to start sewing, wherein the sewing machine controller is configured to, in response to detecting the instruction input by the input unit:

start the sewing-control operation; and output the output data to the embroidery device to start driving of the moving unit in the data-outputting operation.

7. The sewing machine according to claim 2, further comprising a needle plate disposed below the needle bar, wherein the sewing machine controller is configured to, when the embroidery device is connected via the single terminal to the sewing machine, perform a height-determination operation to determine whether the position of the needle in the up-down direction satisfies a predetermined criterion that the needle is located above the needle plate, and wherein, in response to determining that the position of the needle in the up-down direction does not satisfy the predetermined criterion in the height-determination operation, the sewing machine controller is configured to not start the sewing-control operation.

8. The sewing machine according to claim 2, further comprising a needle plate disposed below the needle bar, wherein the sewing machine controller is configured to:

when the embroidery device is connected via the single terminal to the sewing machine, perform a height-determination operation to determine whether the position of the needle in the up-down direction satisfies a predetermined criterion that the needle is located above the needle plate; and in response to determining that the position of the needle in the up-down direction does not satisfy the predetermined criterion in the height-determination operation, perform a moving operation to move the needle bar upward until the position of the needle in the up-down direction satisfies the predetermined criterion in the height-determination operation.

9. The sewing machine according to claim 2, wherein the needle position data output from the sewing machine is a pulse signal.

10. The sewing machine according to claim 2, wherein a circuit of the embroidery device includes a field-effect transistor, and speed data according to a state of the field-effect transistor is input to the sewing machine.

11. An embroidery device comprising:

a connector connectable to the single terminal of the sewing machine according to claim 2;

the embroidery hoop for holding the workpiece;

the moving unit configured to move the embroidery hoop relative to the needle bar of the sewing machine; and the embroidery-device controller configured to control the moving unit to move the embroidery hoop relative to the needle bar during a period in which the embroidery hoop is movable in accordance with the needle position data output from the sewing machine via the connector.

12. A non-transitory computer readable storage medium storing a sewing machine program, executable by a computer of a sewing machine, the sewing machine program causing the computer to perform operations comprising:

receiving speed data from a foot controller connected to the sewing machine via a single terminal of the sewing machine, wherein the single terminal is for connecting the foot controller to the sewing machine and is configured to, when the foot controller is not connected to the sewing machine, allow connection of an external device to the sewing machine;

controlling a sewing machine motor of the sewing machine in accordance with the speed data received;

in a case where the external device is connected to the sewing machine via the single terminal, receiving input data from the external device connected to the sewing machine via the single terminal; and in the case where the external device is connected to the sewing machine via the single terminal, outputting output data to the external device connected to the sewing machine via the single terminal.

* * * * *